US009644434B2

(12) United States Patent
Frith

(10) Patent No.: US 9,644,434 B2
(45) Date of Patent: May 9, 2017

(54) SHOCK ABSORBING UBHO/PULSER SUB ASSEMBLY WITH OPTIONAL MUD FILTER

(71) Applicant: GT Innovations LLC, Lafayette, LA (US)

(72) Inventor: Terrence G. Frith, Lafayette, LA (US)

(73) Assignee: Gordon Technologies LLC, Lafayette, LA (US)

( * ) Notice: Subject to any disclaimer, the term of this patent is extended or adjusted under 35 U.S.C. 154(b) by 0 days.

(21) Appl. No.: 15/085,436

(22) Filed: Mar. 30, 2016

(65) Prior Publication Data

US 2016/0290066 A1 Oct. 6, 2016

Related U.S. Application Data

(60) Provisional application No. 62/140,328, filed on Mar. 30, 2015.

(51) Int. Cl.
*E21B 17/07* (2006.01)
*E21B 47/18* (2012.01)
*E21B 47/024* (2006.01)

(52) U.S. Cl.
CPC ..... *E21B 17/07* (2013.01); *E21B 47/024* (2013.01); *E21B 47/187* (2013.01)

(58) Field of Classification Search
CPC ..... E21B 17/07; E21B 47/187
See application file for complete search history.

(56) References Cited

U.S. PATENT DOCUMENTS 6,016,288 A * 1/2000 Frith ..... E21B 47/187 181/102
7,564,741 B2 7/2009 Pratt et al.
8,640,795 B2 * 2/2014 Jekielek ..... E21B 47/011 166/242.6

* cited by examiner

*Primary Examiner* — Giovanna C Wright
*Assistant Examiner* — Tara Schimpf
(74) *Attorney, Agent, or Firm* — Zeman-Mullen & Ford, LLP

(57) ABSTRACT

A shock sleeve is positioned above a UBHO sleeve, and both are received inside a substantially tubular sub collar. The shock sleeve is free to reciprocate with respect to the UBHO sleeve and sub collar. A mud pulse transmitter valve is received into the shock sleeve. The shock sleeve is interposed between upper and lower shock springs, which provide compensating compression spring bias to dampen the transmitter valve (as received in the shock sleeve) from vibration or shock forces experienced by the sub collar. At least one shock absorbing compression ring interposed between mating portions of the shock sleeve and transmitter valve also dampens the transmitter valve against vibration or shock. An optional mud filter received over the shock sleeve removes particulate matter from drilling fluid before it encounters the shock sleeve.

20 Claims, 4 Drawing Sheets

FIG. 1
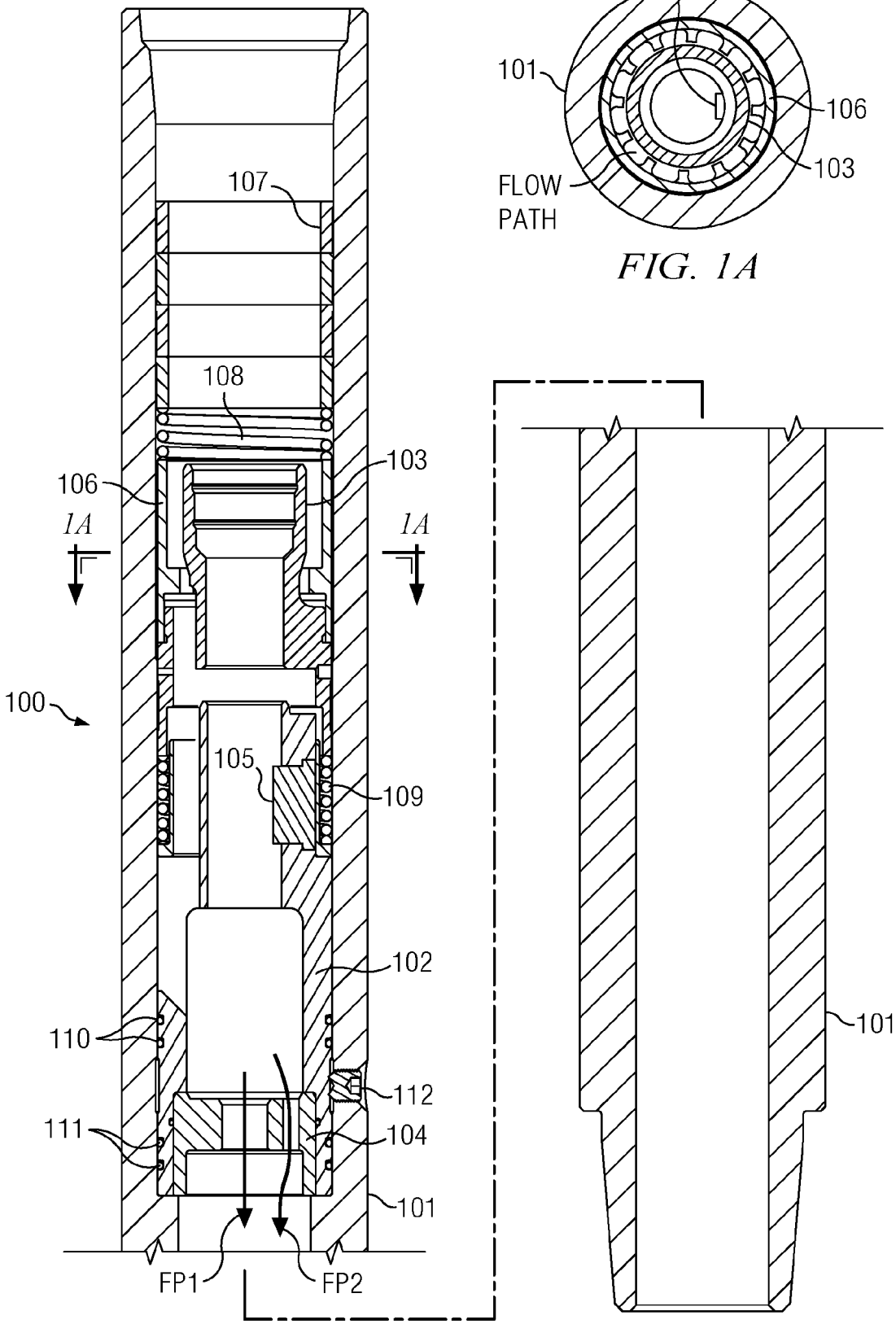
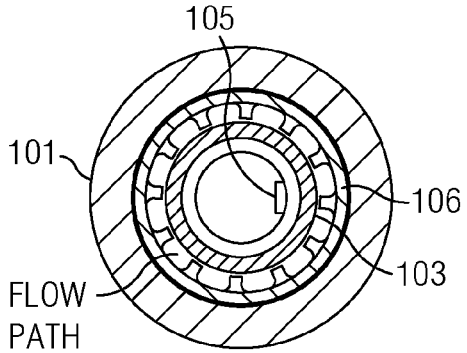
FIG. 1A

SHOCK ABSORBING UBHO/PULSER SUB ASSEMBLY WITH OPTIONAL MUD FILTER

RELATED APPLICATIONS

This application claims the benefit of, and priority to, commonly-invented and commonly-assigned U.S. Provisional Patent Application Ser. No. 62/140,328, filed Mar. 30, 2015.

FIELD OF THE DISCLOSURE

This disclosure is directed generally to subterranean drilling technology, and more specifically to technology useful for protecting fragile and sensitive Measurement-While-Drilling (MWD) equipment from drilling shock and vibration.

BACKGROUND OF THE DISCLOSED TECHNOLOGY

Universal Bore Hole Orientation (UBHO) subs have been used to drill directional oil wells since the 1960s. In order to drill a conventional directional oil well, UBHO subs have been used to orient borehole directional electronics with the bend in the drill string, thereby providing a datum orientation from which to steer the bit and drill pipe. A UBHO sub typically includes a sub connected within the drill string, with a sleeve installed inside the sub. The sleeve provides a metal alignment key. The key and sleeve can be rotated inside the sub to align the key with a bend in the drill string below the UBHO sub, and just above the bit. Once properly oriented, the sleeve is locked in place using set screws inserted from the outside of the sub.

When used with a Positive Displacement Motor (PDM) having a slight bend in the outer housing, directional drillers are able to redirect the path of the oil well bore by simply allowing the PDM to rotate the bit, without rotating the drill pipe. This technique, called "sliding", enables a change of course while drilling by reorienting the bend to a new known direction.

Starting in about 1985, oilfield service companies began using retrievable "MWD" (Measurement While Drilling) systems containing borehole sensor electronics and mud pulse transmitters to transmit downhole numerical data in "real time" to the earth's surface via mud pulse telemetry. By doing so, MWD systems could show the orientation of the bend in the drill string while drilling, therefore allowing oil companies to "steer" a well path by sliding. Starting in about 1986, UBHO subs were adapted for use with MWD systems as the generally preferred technique for orienting directionally sensitive electronics in the MWD system to a datum orientation based on the bend in the drill string/PDM.

In about 1992, retrievable MWD systems were introduced in which the mud pulse transmitter was placed at the bottom of retrievable MWD systems, thereby requiring that the UBHO sub would incorporate the mud pulse transmitter assembly. With the new adaptation, the UBHO sub also incorporated a transmitter orifice in which a hydraulic valve stem could be positioned to create the pressure waves necessary to transmit encoded data from the MWD system.

The present form of the UBHO/Pulser sub has been used without major changes since 1992. However, beginning in about 2008, oilfield service companies began to use the technique of "horizontal drilling" to improve production of certain oil and gas bearing formations. The nature of horizontal drilling, however, causes extended sections of the drill pipe to lay horizontally in the well bore, thereby creating torque and drag issues which effectively limit the horizontal distance that drilling rigs can legitimately reach.

In response, many service companies began to design drilling tools that can physically excite the drill pipe axially (along the length of the pipe) in order to release the torque and drag (friction) of the horizontally-disposed drill pipe against the borehole wall. By doing so, the excitation drilling tools actually make the pipe and drill bit move in a telescoping fashion to keep the drill pipe surface in a "dynamic state", while in contact with the well bore. By constantly moving the drill pipe axially, frictional forces between the drill pipe and the formation wall are greatly reduced. The end result is that directional drillers are able to drill and slide faster and further, thereby reducing the number of days to drill the well.

A major drawback to generating axial movement of the drill pipe, however, is that the telescoping axial forces are hard on the MWD systems in the UBHO sub. MWD systems include downhole sensors, electronics and mechanical packaging that are sensitive to shock and vibration. Studies have shown that the introduction of axial excitation of the drill string actually damages MWD systems once certain G-force levels are reached.

In order to protect MWD systems from shock and vibration, many MWD manufacturers have begun to provide 3-axis shock sensors with the MWD system, to alert personnel when shock levels reach damaging levels. Although the shock data can be provided in real time, often times MWD system damage is suffered before drilling parameters can be altered. The end result is often to simply accept that MWD systems are likely to suffer expensive damages in directional drilling operations, and to write the associated repair/replacement costs off as an overall cost of the drilling process.

Some prior art solutions have tried to protect MWD systems from high shock drilling applications with mechanical dampening packaging in "shock subs" below the MWD systems. Shock subs have been in existence for decades, and are commonly used when drilling in high shock drilling conditions. The disadvantage of shock subs below the MWD system, however, is that because such subs can average 7 feet in length, their introduction has the effect of locating the MWD electronics and sensors further from the bit, thereby making it more difficult to steer during drilling operations.

Another option to stave off potential damage to MWD systems has been to provide a shock absorber between the mud pulse transmitter and the electronics section of the MWD system to protect the MWD electronics from axial shock. As with the shock sub option, the MWD shock absorber also moves the MWD sensors further from the bit. It also does not provide protection for the mud pulse transmitter and UBHO sleeve from axial shock.

A third option is disclosed in U.S. Pat. No. 8,640,795, inventor Jekielek. A disclosed apparatus includes a UBHO sub, sleeve, and transmitter orifice riding on top of a shock absorber. Again, although the design reduces axial shock to MWD systems, it combines a UBHO sub with a shock sub, and thereby moves MWD sensors further from the bit.

There is therefore a need for a unitary shock absorbing UBHO sub that will protect MWD systems from axial and lateral forces during drilling operations, while still maintaining operably low MWD distance from the bit. Additional mud filtering capability may be provided on board. Advantageously, a customized mud pulser assembly will also be provided, adapted for optimal use with the shock absorbing UBHO sub, thereby enabling telemetry between the MWD equipment on board the UBHO sub and the surface.

SUMMARY AND TECHNICAL ADVANTAGES

The needs in the prior art described above in the "Background" section are addressed by a shock absorbing UBHO sub, embodiments of which are set forth in this disclosure. This disclosure also describes embodiments of a mud pulse transmitter valve adapted for use with the shock absorbing UBHO sub. This disclosure also describes and optional mud filter screen adapted for use with the shock absorbing UBHO sub.

A shock sleeve is positioned above a UBHO sleeve, and both are received inside a substantially tubular sub collar. A mud pulse transmitter valve is received into the shock sleeve. In some embodiments, the shock sleeve is free to reciprocate with respect to the UBHO sleeve and sub collar. In such embodiments, the shock sleeve is interposed between upper and lower shock springs, which provide compensating compression spring bias to dampen the transmitter valve (as received in the shock sleeve) from vibration or shock forces experienced by the sub collar. In other embodiments, at least one shock absorbing compression ring interposed between mating portions of the shock sleeve and transmitter valve also dampens the transmitter valve against vibration or shock. An optional mud filter received over the shock sleeve removes particulate matter from drilling fluid before it encounters the shock sleeve.

According to a first aspect, the disclosed shock absorbing device is a shock absorbing UBHO/pulser assembly, comprising a generally cylindrical UBHO sleeve received inside a substantially tubular sub collar, the UBHO sleeve having first and second ends, the first end of the UBHO connected to a substantially cylindrical main orifice unit; a generally cylindrical shock sleeve having first and second ends, the second end of the shock sleeve providing an internal circular opening, the first end of the shock sleeve received over the second end of the UBHO sleeve; a helical lower shock spring interposed between the first end of the shock sleeve and the second end of the UBHO sleeve such that the shock sleeve is in compression spring bias with the UBHO sleeve; and at least one cylindrical compression ring affixed to an interior wall of the sub collar, a helical upper shock spring interposed between the compression ring and the second end of the shock sleeve such that the shock sleeve is in compression spring bias with the compression ring. The upper and lower shock springs are engaged in reciprocating compression and release so as to allow the shock sleeve dampened reciprocating displacement with respect to the sub collar via compensating compression spring bias between the upper and lower shock springs. The device according to a first aspect further comprises a generally tubular valve stem having first and second ends, a valve tip connected to the first end of the valve stem, the valve tip configured to restrict the main orifice unit when engaged therewith; a generally tubular orienting stinger having first and second ends, first end of the valve stem received into the second end of the stinger so as to allow the valve stem reciprocating displacement within the stinger; and a crossover sub having first and second ends, the first end of the crossover sub received into the second end of the stinger, the second end of the crossover sub configured for mating with a mud pulse transmitter servo controller. The stinger is received into the circular opening in the shock sleeve such that an exterior mating portion of the stinger engages with a corresponding interior mating portion of the shock sleeve. Engagement of the stinger within the shock sleeve allows the stinger dampened reciprocating displacement with respect to the sub collar via compensating compression spring bias between the upper and lower shock springs. Reciprocating displacement of the valve stem within the stinger causes corresponding displacement of the valve tip towards and away from the main orifice unit.

According to a second aspect, the disclosed shock absorbing device is a shock absorbing UBHO/pulser assembly, comprising a generally cylindrical UBHO sleeve received inside a substantially tubular sub collar, the UBHO sleeve having first and second ends, the first end of the UBHO connected to a substantially cylindrical main orifice unit; a generally cylindrical shock sleeve having first and second ends, the second end of the shock sleeve providing an internal circular opening, the first end of the shock sleeve received over the second end of the UBHO sleeve; a generally tubular valve stem having first and second ends, a valve tip connected to the first end of the valve stem, the valve tip configured to restrict the main orifice unit when engaged therewith; a generally tubular orienting stinger having first and second ends, first end of the valve stem received into the second end of the stinger so as to allow the valve stem reciprocating displacement within the stinger; a crossover sub having first and second ends, the first end of the crossover sub received into the second end of the stinger, the second end of the crossover sub configured for mating with a mud pulse transmitter servo controller. The stinger is received into the circular opening in the shock sleeve such that an exterior mating portion of the stinger engages with a corresponding interior mating portion of the shock sleeve. At least one shock absorbing compression ring is interposed and compressed between the exterior portion mating portion of the stinger and the interior mating portion of the shock sleeve, the compressed shock absorbing compression ring providing dampening radial spring bias between the stinger and the shock sleeve. Reciprocating displacement of the valve stem within the stinger causes corresponding displacement of the valve tip towards and away from the main orifice unit.

Embodiments of the second aspect may further comprise a helical lower shock spring interposed between the first end of the shock sleeve and the second end of the UBHO sleeve such that the shock sleeve is in compression spring bias with the UBHO sleeve; at least one cylindrical compression ring affixed to an interior wall of the sub collar, and a helical upper shock spring interposed between the compression ring and the second end of the shock sleeve such that the shock sleeve is in compression spring bias with the compression ring. The upper and lower shock springs are engaged in reciprocating compression and release so as to allow the shock sleeve dampened reciprocating displacement with respect to the sub collar via compensating compression spring bias between the upper and lower shock springs. Engagement of the stinger within the shock sleeve allows the stinger dampened reciprocating displacement with respect to the sub collar via compensating compression spring bias between the upper and lower shock springs.

According to a third aspect, the disclosed shock absorbing device is a shock absorbing UBHO/pulser assembly, comprising a substantially tubular sub collar having a substantially cylindrical interior wall, the interior wall providing an annular collar shoulder; a generally cylindrical UBHO sleeve having first and second ends, a substantially cylindrical main orifice unit received into the first end of the UBHO sleeve, the main orifice unit and the UBHO sleeve together received into the sub collar until the first end of the UBHO sleeve abuts against the annular collar shoulder; a generally cylindrical shock sleeve having first and second ends, the second end of the shock sleeve providing an internal circular opening, the first end of the shock sleeve received over the second end of the UBHO sleeve; a helical lower shock spring interposed between the first end of the shock sleeve and the second end of the UBHO sleeve such that the shock sleeve is in compression spring bias with the UBHO sleeve; at least one cylindrical compression ring affixed to the interior wall of the sub collar; a helical upper shock spring interposed between the compression ring and the second end of the shock sleeve such that the shock sleeve is in compression spring bias with the compression ring. The upper and lower shock springs are engaged in reciprocating compression and release so as to allow the shock sleeve dampened reciprocating displacement with respect to the sub collar via compensating compression spring bias between the upper and lower shock springs. The device according to a third aspect further comprises a generally tubular valve stem having first and second ends, a valve tip connected to the first end of the valve stem, a generally cylindrical piston received over and affixed to the second end of the valve stem; the second end of the valve stem further providing an exterior annular valve stem shoulder, the valve stem shoulder located towards the first end of the valve stem and away from the piston; a generally tubular orienting stinger having first and second ends, first end of the valve stem received into the second end of the stinger so as to allow the valve stem reciprocating displacement within the stinger, the second end of the stinger providing a stinger shoulder, abutment of the stinger shoulder against the valve stem shoulder limiting displacement of the first end of the valve stem in a direction away from the second end of the stinger; a generally tubular stinger extension having first and second ends, the first end of the stinger housing received over the second end of the stinger, the stinger extension further having an interior stinger extension wall with a predetermined stinger extension wall diameter, the stinger extension wall diameter selected such that the piston on the first end of the valve stem is in sealed reciprocating piston engagement with the stinger extension wall; a crossover sub having first and second ends, the first end of the crossover sub received into the second end of the stinger extension, the second end of the crossover sub configured for mating with a mud pulse transmitter servo controller, the first end of the crossover sub further providing a recessed piston housing, the piston housing shaped to receive and abut with the piston as affixed to the second end of the valve stem, abutment of the piston against the piston housing limiting displacement of the first end of the valve stem in a direction towards the second end of the stinger; and a helical valve spring interposed between the valve stem and the stinger, such that compression bias of the valve spring discourages displacement of the first end of the valve stem in a direction towards the second end of the stinger. The stinger is received into the circular opening in the shock sleeve such that an exterior mating portion of the stinger engages with a corresponding interior mating portion of the shock sleeve, at least one shock absorbing compression ring interposed and compressed between the exterior portion mating portion of the stinger and the interior mating portion of the shock sleeve, the compressed shock absorbing compression ring providing dampening radial spring bias between the stinger and the shock sleeve. Engagement of the stinger within the shock sleeve allows the stinger dampened reciprocating displacement with respect to the sub collar via compensating compression spring bias between the upper and lower shock springs. Reciprocating displacement of the piston causes corresponding displacement of the valve tip towards and away from the main orifice unit. Compression spring bias of the helical valve spring encourages restriction of the main orifice unit by the valve tip.

It is therefore a technical advantage of the disclosed shock absorbing device to provide both axial and lateral shock dampening protection for MWD systems deployed in UBHO subs. In embodiments that also include the disclosed optional MWD mud pulse transmitter valve, such dampening protection will also be available to the valve.

A further technical advantage is that the disclosed shock absorbing device does not require sensors and related electronics in MWD systems to be located further from the bit.

A further technical advantage is attained in embodiments of the disclosed shock absorbing device that include an optional mud filter built into the UBHO sub that filters out foreign debris. The mud filter reduces the chance of jamming or obstruction of the mud pulse transmitter valve and associated MWD systems with mud debris during drilling operations.

The foregoing has outlined rather broadly some of the features and technical advantages of the disclosed shock absorbing device and its related optional add-ons, in order that the detailed description that follows may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described and as set forth in the appended claims.

BRIEF DESCRIPTION OF THE DRAWINGS

For a more complete understanding of the embodiments described in this disclosure, and their advantages, reference is made to the following detailed description taken in conjunction with the accompanying drawings, in which:

FIG. 1 illustrates an embodiment of a shock absorbing UBHO sub in accordance with this disclosure;

FIG. 1A is a section as shown on FIG. 1;

DETAILED DESCRIPTION

Figure 2:
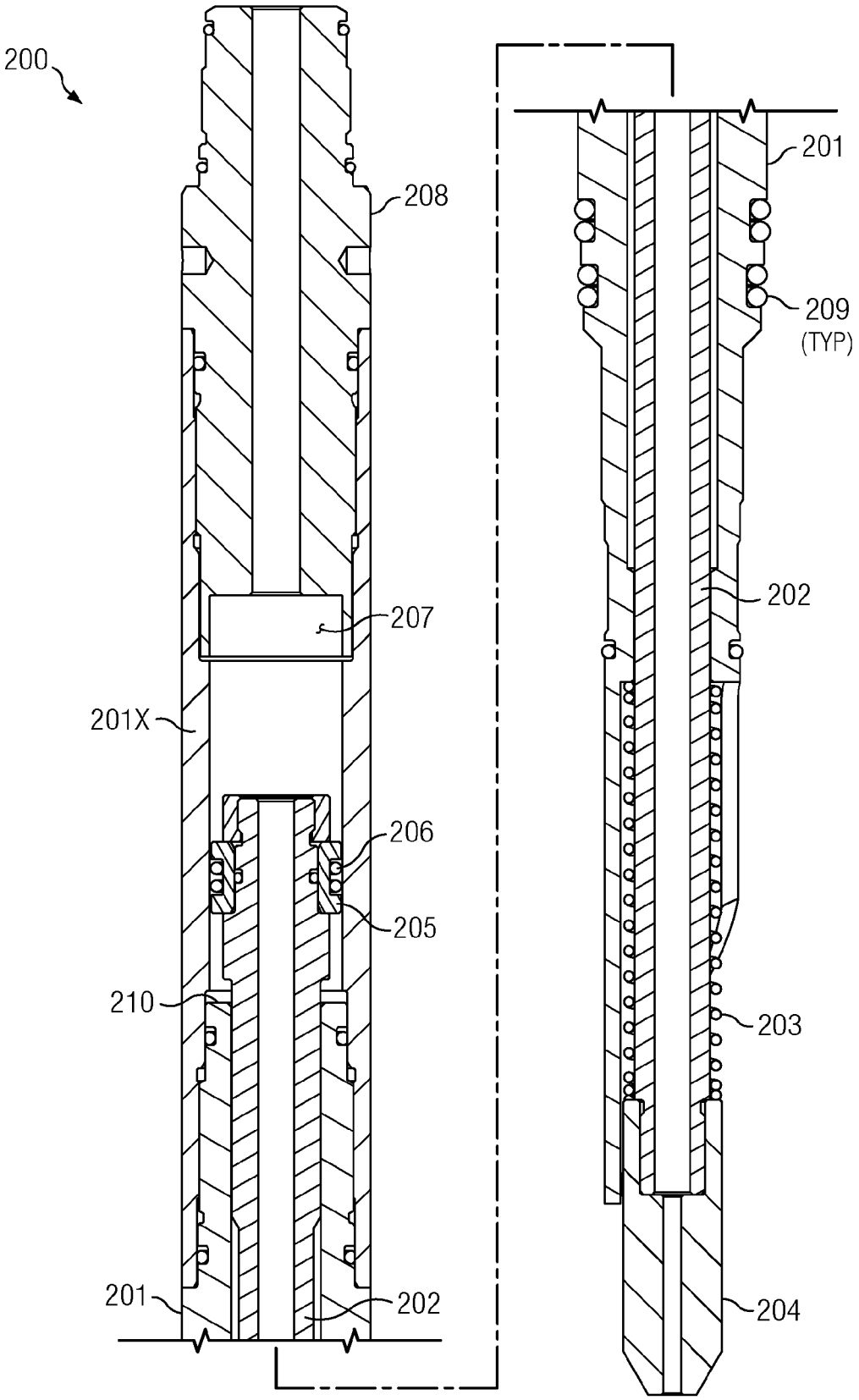
FIG. 2 illustrates, in isolation, an embodiment of a mud pulse transmitter valve adapted for use with the UBHO sub of FIG. 1.

Reference is now made to FIGS. 1 through 3B in describing the currently preferred embodiments of the disclosed shock absorbing UBHO sub, mud pulse transmitter valve and related features. For the purposes of the following disclosure, FIGS. 1 through 3B should be viewed together. Any part, item, or feature that is identified by part number on one of FIGS. 1 through 3B will have the same part number when illustrated on another of FIGS. 1 through 3B. It will be understood that the embodiments as illustrated and described with respect to FIGS. 1 through 3B are exemplary, and the scope of the inventive material set forth in this disclosure is not limited to such illustrated and described embodiments.

FIG. 1 illustrates an embodiment of a shock absorbing UBHO sub 100 in accordance with this disclosure. UBHO sub 100 comprises substantially tubular UBHO sub collar 101, providing conventional pin and box ends for insertion in the drill string. Embodiments of UBHO sub collar 101 may be made from conventional non-magnetic material such as stainless steel, as is known in the art. UBHO sub collar 101 is adapted to receive UBHO sleeve 102 as shown on FIG. 1. UBHO sleeve 102 is in turn adapted to receive shock sleeve 103 as also shown on FIG. 1. It will be understood that in some embodiments, UBHO sleeve 102 may be modified from a conventional UBHO sleeve. FIG. 1 further illustrates UBHO sleeve 102 providing main orifice 104 (for mud pulse telemetry), and alignment key 105 (for MWD orientation), as is also conventional in the art. Set screws 112 secure UBHO sleeve 102, main orifice 104 and alignment key 105 in place at the desired orientation in UBHO sub collar 101, thereby eliminating the need for "dynamic seals" around and below main orifice 104, as are often required on conventional UBHO subs. Unlike such conventional UBHO subs, the design according to FIG. 1 keeps UBHO sleeve 102, main orifice 104 and alignment key 105 in fixed and locked position (via set screws 112) allowing the use of "static seals" 110 and 111 to seal the interface of UBHO sleeve 102 and UBHO sub collar 101.

Referring further to FIG. 1, the seating area of shock sleeve 103 above UBHO sleeve 102 will be seen to be allowed independent axial movement relative to UBHO sleeve 102 (as fixed to UBHO sub collar 101 by set screws 112), where such axial movement is dampened by upper and lower shock springs 108 and 109. Upper shock spring 108 is retained by sub collar compression rings 107, and lower shock spring 109 is retained between shock sleeve 103 and UBHO sleeve 102. In summary, therefore, FIG. 1 illustrates a self-contained shock absorber device in a unitary UBHO sub 100, requiring no additional sub length as compared to conventional UBHO subs without shock absorbing functionality.

With further reference to FIG. 1, main orifice 104 provides two flow paths FP1 and FP2. It will be understood that as illustrated, FP1 is through a center hole in main orifice 104, while FP2 is via a series of perimeter holes in an annular arrangement. In currently preferred embodiments, the center hole and perimeter holes are sized and arranged to ordain about 50% flow each between FP1 and FP2, although this disclosure is not limited in this regard. In order to enable mud pulse telemetry in association with the disclosed shock absorbing UBHO sub, the design of main orifice 104 provides for complete opening and closing of the center hole in main orifice 104 during mud pulse telemetry, while allowing the perimeter holes in to remain open at all times.

It is recognized that due to the telescoping nature of the shock absorbing UBHO sub disclosed herein, the disclosed UBHO sub will likely not be compatible with conventional mud pulse transmitter valve designs currently on the market. A new mud pulse transmitter valve design would therefore be highly advantageous in order to enable mud pulse telemetry with the disclosed shock absorbing UBHO sub. A primary feature of the new design will allow additional travel of the valve stem relative to main orifice 104, so that measured changes in mud pressure caused by opening/closing of the valve are more exaggerated, causing a larger net mud pulse amplitude for telemetry than is available in conventional designs.

FIG. 2 illustrates an embodiment of a new mud pulse transmitter valve 200 customized for use with the disclosed shock absorbing UBHO sub, an embodiment of which is described above with reference to FIG. 1. As shown on FIG. 2, mud pulse transmitter valve 200 comprises valve stem 202 deployed within orienting stinger 201. Valve stem 202 is permitted independent axial movement relative to orienting stinger 201 within orienting stinger 201, where such axial movement is biased and dampened by valve spring 203. Valve tip 204 is attached to the lower end of valve stem 202 (advantageously, threaded on) so as to retain valve spring around valve stem 202 within orienting stinger 201.

It will be seen on FIG. 2 that valve spring 203 is biased to exert a downward force on valve stem 202, urging it to exit orienting stinger 201 at the lower end. However, piston 205 at the upper end of valve stem 202 is configured to abut shoulder 210 on orienting stinger 201, and thereby arrest the downward movement of valve stem 202 responsive to valve spring 203 before valve stem 202 can exit from orienting stinger 201. Piston seal 206 seals piston 205 around the internal surface of orienting stinger extension 201X.

The upward axial movement of valve stem 202 will be seen on FIG. 2 to be limited by piston 205 abutting piston housing 207 formed in crossover sub 208. The design, as embodied in FIG. 2, thus creates a predesigned and limited amount of axial displacement of valve stem 202 that is biased and dampened by valve spring 203. As shown on FIGS. 3A and 3B, crossover sub 208 may be attached at its upper end to conventional mud pulse transmitter servo controller 500.

Figure 3A:
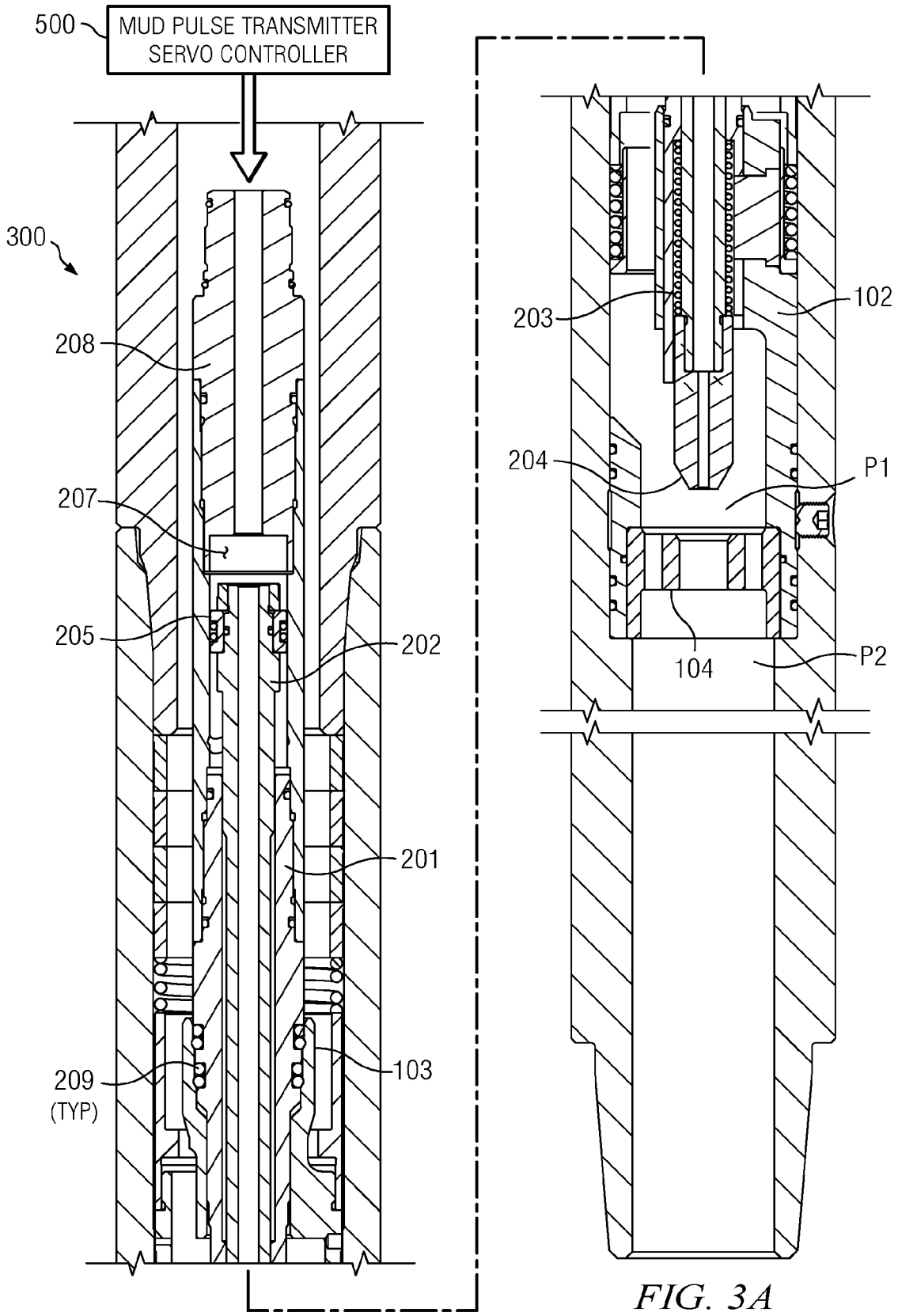
FIGS. 3A and 3B illustrate an assembly of the mud pulse transmitter valve of FIG. 2 deployed within the UBHO sub of FIG. 1, with FIG. 3A depicting the assembly in "valve open" mode, and FIG. 3B depicting "valve closed" mode.
Figure 3B:
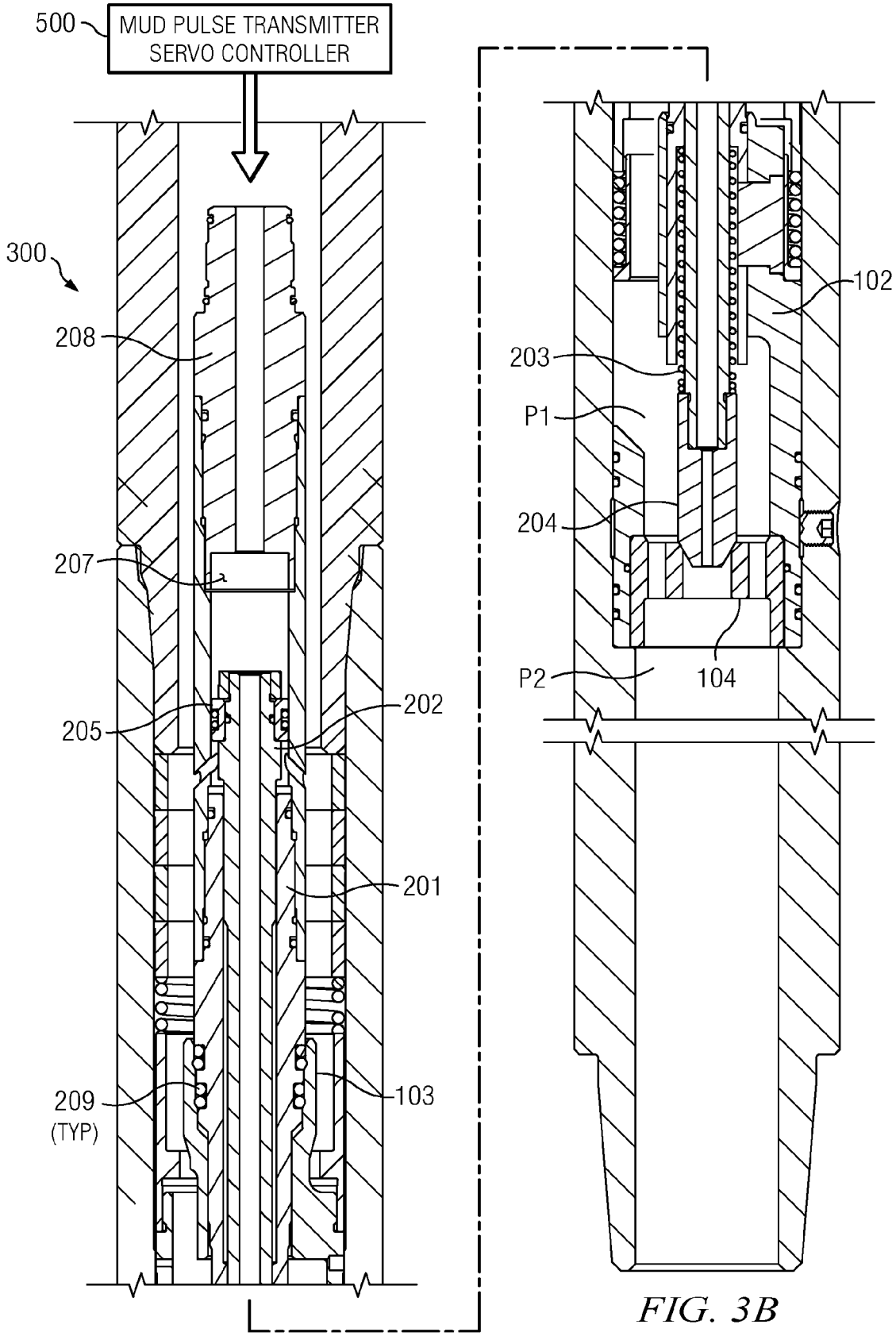

FIGS. 3A and 3B depict mud pulse transmitter valve 200 on FIG. 2 deployed inside shock absorbing UBHO sub 100 of FIG. 1. The overall assembly (labeled on each of FIGS. 3A and 3B as mud pulse transmitter valve assembly 300) is depicted in "valve open" mode in FIG. 3A, and in "valve closed" mode in FIG. 3B. Referring first to FIG. 3B, when drilling commences at a rig site, drilling mud is pumped past the MWD system above shock absorbing mud pulse valve transmitter assembly 300 (MWD system not illustrated), around UBHO sleeve 102 and shock sleeve 103, and through main orifice 104, creating a pressure loss across the orifice. Lower pressure mud P2 funnels from below main orifice 104, upward through the hollow tube in valve stem 202 and into the chamber between piston 205 and piston housing 207. At the same time, the higher pressure mud P1 above main orifice 104 urges valve tip 204 upward to overcome the bias of valve spring 203, thereby lifting valve stem 202 away from main orifice 104.

Meanwhile, mud pulse transmitter servo controller 500 mounted onto and above mud pulse transmitter valve assembly 300, controls the relative axial position of valve stem 202 (and thus valve tip 204) by opening and closing a mud flow path from outside and above the piston housing 207, and into and above piston 205, thereby altering the hydraulic pressure of mud inside the chamber between piston 205 and piston housing 207. As illustrated on FIG. 3B, when mud pulse transmitter servo controller 500 is open, higher pressure mud P1 is allowed to enter the chamber above piston 205, neutralizing the pressure differential above and below valve tip 204, causing the valve spring 203 to force valve tip 204 downwards to close the center hole of main orifice 104. The resulting restriction of drilling mud flowing through the main orifice 104 causes an increase (spike) in mud pressure that can be measured all the way up at the surface at the mud pump.

Conversely, as illustrated on FIG. 3A, when mud pulse transmitter servo controller 500, lower pressure mud P2 from below main orifice 104 funnels from below main orifice 104 back upward through the hollow tube in valve stem 202 and into the chamber between piston 205 and piston housing 207. The reduction in pressure in the chamber above piston 205 causes valve tip 204 to separate from main orifice 104. Once initially separated, high mud pressure P1 above main orifice 104 urges valve tip 204 to further separate from main orifice 104 against the bias of valve spring 203, allowing mud to flow through the center hole of main orifice 104. The renewed flow of mud through main orifice 104 causes a drop in mud pressure from the previous spike (FIG. 3B, valve closed) that can again be measured all the way up at the surface at the mud pump. Precisely timed pressure spikes ("mud pulses") created in this way can be encoded to transmit data from the MWD system to the surface ("mud pulse telemetry").

It will be appreciated from FIGS. 2, 3A and 3B that in the illustrated embodiments, valve tip 204 advantageously provides a conical design for interface with the center hole of main orifice 104. This conical design funnels lower mud pressures found deeper below the main orifice 104 into the center hole of main orifice 104. As a result, in "valve open" mode (FIG. 3A), this conical design forces greater separation between valve tip 204 and main orifice 104 (that is, forces the valve to open further) than is provided in conventional mud pulse transmitter valve assemblies. The resulting differential axial travel of valve stem 202 between "open" and "closed" modes is greater, causing a greater measurable spike/drop in mud pressure when the valve closes and opens. This in turn creates a larger net mud pulse amplitude for telemetry than is available in conventional designs.

Several suitable conventional mud pulse transmitter servo controllers 500 are currently available for use with the mud pulse transmitter valve assembly 300 illustrated on FIGS. 3A and 3B, although mud pulse transmitter valve assembly 300 as described in this disclosure is not limited to any particular servo controller. See, for example, commercial embodiments of the servo controllers disclosed in U.S. Pat. No. 6,016,288 ("Servo-Driven Mud Pulser"), and U.S. Pat. No. 7,564,741 ("Intelligent Efficient Servo-Actuator for a Downhole Pulser"). Embodiments of the disclosed shock absorbing UBHO sub and associated mud pulse transmitter valve are compatible with such servo controllers, providing axial shock absorbers at one or both of two locations as further described immediately below: (1) between the mud pulse transmitter valve and the shock sleeve (item 103 on FIG. 1) via shock absorbing stinger compression rings 209; and (2) between the shock sleeve and UBHO sleeve (item 102 on FIG. 1) via upper and lower shock springs 108 and 109.

It will be appreciated that with reference to FIGS. 2, 3A and 3B, orienting stinger 201 is uniquely disclosed to seat (a) the entire mud pulse transmitter valve assembly 300, and (b) the entire MWD string (not illustrated) connected above the mud pulse transmitter valve assembly 300, on top of and inside shock sleeve 103. Vibration dampening or shock/concussion dampening is thus provided via either or both of two mechanisms.

First, as shown on FIGS. 2, 3A and 3B, shock absorbing stinger compression rings 209 are provided to seal and pressure lock orienting stinger 201 into shock sleeve 103. Shock absorbing stinger compression rings 209 may be of any suitable commercially-available construction, such as metal, or elastomer (e.g. rubber), or a hybrid of metal and rubber, and it will be appreciated that the scope of this disclosure is not limited in this regard. However, one exemplary serviceable construction for shock absorbing stinger compression rings 209, providing good dampening characteristics, is a hybrid construction using a plurality of flat metal washers with a rubber o-ring interposed between each washer. Such a general type of hybrid construction is conventional in engine mounts in other applications. The o-ring (s) in such exemplary hybrid construction for shock absorbing stinger compression rings 209 may be a Parker 300-series, 90-durometer rubber o-ring, and more preferably part number 336. The washers may be a conventional flat metal washer, ⅛-inch thick, with substantially the same inner and outer diameter as the o-rings, sized to suit the recess diameter and the outer diameter of orienting stinger 201 at the point at which shock absorbing stinger compression rings 209 are provided. It will be appreciated that shock absorbing stinger compression rings 209 provide radial spring bias away from the axial centerline of orienting stinger 201 when shock absorbing singe compression rings 209 are received tightly into their annular recesses on the exterior wall of orienting stinger 201. This radial spring bias becomes most active when orienting stinger 201 is received into and engaged with shock sleeve 103. The radial spring bias may be provided by, for example, resilience of compressed rubber and/or spring bias in compressed steel components in the construction of embodiments of shock absorbing stinger compression rings 209. It has been found in service that the above-described hybrid construction has provided vibration and shock dampening performance results that have exceeded expectations in high shock drilling applications, in that increased compression of stinger compression rings 209 in response to high shock has yielded non-linear resilience, showing amplified overall resilience with increased compression without reaching a metal-metal "solid" point (at which point no further resilience is available). The radial spring bias and the compression pressure lock provided in shock absorbing stin er compression rings 209 are both operable to dampen vibration or absorb shock/concussion in the connection between orienting stinger 201 and shock sleeve 103. The pressure lock feature is further advantageous because it deters the mud pulse transmitter valve assembly 300, with mud pulse transmitter servo controller 500 and MWD string attached (not illustrated), from "unseating" during periods of high axial shock during drilling operations.

Second, as shown on FIG. 1, upper and lower shock springs 108 and 109 are configured to engage in reciprocating compression and release with shock sleeve 103 interposed between them. The resulting compensating compression spring bias between upper and lower shock springs 108 and 109 places shock sleeve 103 (and thus the entire mud pulse transmitter valve assembly 200 by connection into shock sleeve 103) in dampened reciprocating displacement against vibration in UBHO sub collar 101, or against other externally-created shock or concussion forces.

It will be appreciated that consistent with the scope of this disclosure, embodiments of the disclosed technology may provide vibration dampening and shock/concussion absorption with both mechanisms described above in this paragraph (as shown on FIGS. 3A and 3B) deployed on a particular assembly. Other embodiments may provide vibration dampening and shock/concussion absorption via just the first mechanism deployed (not illustrated), providing shock absorbing stinger compression rings 209 but not upper and lower shock springs 108 and 109. Conversely, yet other embodiments may provide vibration dampening and shock/concussion absorption via just the second mechanism deployed (not illustrated), providing upper and lower shock springs 108 and 109 but not shock absorbing stinger compression rings 209.

FIG. 1A is a section as shown on FIG. 1. FIG. 1A illustrates an optional mud filter screen 106 deployed into the flow area ("FLOW PATH" on FIG. 1A) around the outside of shock sleeve 103. Mud filter screen 106 acts to collect mud-borne junk and debris before it reaches main orifice 104, thereby mitigating against such debris jamming, obstructing or otherwise affecting the performance of mud pulse transmitter valve assembly 300 as illustrated on FIGS. 3A and 3B.

Variations:

In order to accommodate owners of existing UBHO sub designs, the scope of this disclosure allows for such existing subs to be modified for use with the new design. There could be at least two variations. One would include a shock sleeve above the UBHO sleeve and main orifice (as disclosed with reference to FIG. 1), while a second variation would include a UBHO sleeve and main orifice of unitary ("solid") construction, retrofitted to be compatible with the mud pulse transmitter valve design described and illustrated with reference to FIG. 2.

This disclosure is not limited to variations of size of shock absorbing UBHO assemblies to suit drilling hole sizes that could range, for example, from 4¾ inch to 17½ inch diameters.

With reference to FIG. 1A, mud filter screen 106 will vary in size and construction due to projected well conditions. Slot widths for individual mud filter screens 106 will vary to suit flow rates, so as to allow for effective filtering without causing excessive erosion due to high fluid velocities.

With reference now to FIGS. 1, 1A, 3A and 3B, a further advantage of the disclosed mud filter screen 106 is that in the event the filter becomes full of debris, the MWD system and transmitter valve can be retrieved, thereby allowing for a secondary flow path to be opened through the center of the shock sleeve 103 and UBHO sleeve 102. This feature is highly advantageous to well operators seeking to control and counteract high well bore pressures via the use of, for example, high density muds. The alternate mud flow path provided once the MWD system and transmitter valve has been retrieved (following an obstructed primary flow path) enables the continued flow of the high density mud, thus assisting well operators in keeping control of high pressures.

Although the inventive material in this disclosure has been described in detail along with some of its technical advantages, it will be understood that various changes, substitutions and alternations may be made to the detailed embodiments without departing from the broader spirit and scope of such inventive material as set forth in the following claims.

I claim:

1. A shock absorbing universal bore hole orientation (UBHO)/pulser assembly, comprising:

a generally cylindrical UBHO sleeve received inside a substantially tubular sub collar, the UBHO sleeve having first and second ends, the first end of the UBHO connected to a substantially cylindrical main orifice unit;

a generally cylindrical shock sleeve having first and second ends, the second end of the shock sleeve providing an internal circular opening, the first end of the shock sleeve received over the second end of the UBHO sleeve;

a helical lower shock spring interposed between the first end of the shock sleeve and the second end of the UBHO sleeve such that the shock sleeve is in compression spring bias with the UBHO sleeve;

at least one cylindrical sub collar compression ring affixed to an interior wall of the sub collar, a helical upper shock spring interposed between the sub collar compression ring and the second end of the shock sleeve such that the shock sleeve is in compression spring bias with the sub collar compression ring;

the upper and lower shock springs engaged in reciprocating compression and release so as to allow the shock sleeve dampened reciprocating displacement with respect to the sub collar via compensating compression spring bias between the upper and lower shock springs;

a generally tubular valve stem having first and second ends, a valve tip connected to the first end of the valve stem, the valve tip configured to restrict the main orifice unit when engaged therewith;

a generally tubular orienting stinger having first and second ends, first end of the valve stem received into the second end of the stinger so as to allow the valve stem reciprocating displacement within the stinger;

a crossover sub having first and second ends, the first end of the crossover sub received into the second end of the stinger, the second end of the crossover sub configured for mating with a mud pulse transmitter servo controller;

the stinger received into the circular opening in the shock sleeve such that an exterior mating portion of the stinger engages with a corresponding interior mating portion of the shock sleeve; and wherein engagement of the stinger within the shock sleeve allows the stinger dampened reciprocating displacement with respect to the sub collar via compensating compression spring bias between the upper and lower shock springs, and wherein reciprocating displacement of the valve stem within the stinger causes corresponding displacement of the valve tip towards and away from the main orifice unit.

2. The shock absorbing UBHO/pulser assembly of claim 1, further comprising:

a mud filter screen received over the second end of the shock sleeve, the mud filter screen configured to remove particulate matter from fluid prior to said fluid encountering the shock sleeve.

3. The shock absorbing UBHO/pulser assembly of claim 1, further comprising:

a helical valve spring interposed between the valve stem and the stinger, such that compression bias of the valve spring discourages displacement of the first end of the valve stem in a direction towards the second end of the stinger, wherein compression spring bias of the valve spring encourages restriction of the main orifice unit by the valve tip.

4. The shock absorbing UBHO/pulser assembly of claim 1, further comprising:

a generally cylindrical piston received over and affixed to the second end of the valve stem; and a generally tubular stinger extension having first and second ends, the first end of the stinger housing received over the second end of the stinger, the stinger extension further having an interior stinger extension wall with a predetermined stinger extension wall diameter, the stinger extension wall diameter selected such that the piston on the first end of the valve stem is in sealed reciprocating piston engagement with the stinger extension wall.

5. The shock absorbing UBHO/pulser assembly of claim 4, further comprising:

the first end of the crossover sub further providing a recessed piston housing, the piston housing shaped to receive and abut with the piston as affixed to the second end of the valve stem, abutment of the piston against the piston housing limiting displacement of the first end of the valve stem in a direction towards the second end of the stinger.

6. The shock absorbing UBHO/pulser assembly of claim 1, in which reciprocating displacement of the valve stem within the stinger is independent of reciprocating displacement of the shock sleeve with respect to the sub collar.

7. A shock absorbing universal bore hole orientation (UBHO)/pulser assembly, comprising:

a generally cylindrical UBHO sleeve received inside a substantially tubular sub collar, the UBHO sleeve having a UBHO sleeve wall, an alignment key rigidly connected to the UBHO sleeve wall and extending radially inward away from the UBHO sleeve wall, the UBHO sleeve further having first and second ends, the first end of the UBHO connected to a substantially cylindrical main orifice unit;

a generally cylindrical shock sleeve having first and second ends, the second end of the shock sleeve providing an internal circular opening, the first end of the shock sleeve received over the second end of the UBHO sleeve;

a generally tubular valve stem having first and second ends, a valve tip connected to the first end of the valve stem, the valve tip configured to restrict the main orifice unit when engaged therewith;

a generally tubular orienting stinger having first and second ends, first end of the valve stem received into the second end of the stinger so as to allow the valve stem reciprocating displacement within the stinger;

a crossover sub having first and second ends, the first end of the crossover sub received into the second end of the stinger, the second end of the crossover sub configured for mating with a mud pulse transmitter servo controller;

the stinger received into the circular opening in the shock sleeve such that an exterior mating portion of the stinger engages with a corresponding interior mating portion of the shock sleeve, at least one shock absorbing stinger compression ring interposed and compressed between the exterior mating portion of the stinger and the interior mating portion of the shock sleeve, wherein the compressed shock absorbing stinger compression ring provides dampening radial spring bias between the stinger and the shock sleeve; and wherein reciprocating displacement of the valve stem within the stinger causes corresponding displacement of the valve tip towards and away from the main orifice unit.

8. The shock absorbing UBHO/pulser assembly of claim 7, further comprising:

a helical lower shock spring interposed between the first end of the shock sleeve and the second end of the UBHO sleeve such that the shock sleeve is in compression spring bias with the UBHO sleeve;

at least one cylindrical sub collar compression ring affixed to an interior wall of the sub collar, a helical upper shock spring interposed between the sub collar compression ring and the second end of the shock sleeve such that the shock sleeve is in compression spring bias with the sub collar compression ring;

the upper and lower shock springs engaged in reciprocating compression and release so as to allow the shock sleeve dampened reciprocating displacement with respect to the sub collar via compensating compression spring bias between the upper and lower shock springs; and wherein engagement of the stinger within the shock sleeve allows the stinger dampened reciprocating displacement with respect to the sub collar via compensating compression spring bias between the upper and lower shock springs.

9. The shock absorbing UBHO/pulser assembly of claim 7, further comprising:

a mud filter screen received over the second end of the shock sleeve, the mud filter screen configured to remove particulate matter from fluid prior to said fluid encountering the shock sleeve.

10. The shock absorbing UBHO/pulser assembly of claim 8, further comprising:

a mud filter screen received over the second end of the shock sleeve, the mud filter screen configured to remove particulate matter from fluid prior to said fluid encountering the shock sleeve.

11. The shock absorbing UBHO/pulser assembly of claim 7, further comprising:

a helical valve spring interposed between the valve stem and the stinger, such that compression bias of the valve spring discourages displacement of the first end of the valve stem in a direction towards the second end of the stinger, wherein compression spring bias of the valve spring encourages restriction of the main orifice unit by the valve tip.

12. The shock absorbing UBHO/pulser assembly of claim 8, further comprising:

a helical valve spring interposed between the valve stem and the stinger, such that compression bias of the valve spring discourages displacement of the first end of the valve stem in a direction towards the second end of the stinger, wherein compression spring bias of the valve spring encourages restriction of the main orifice unit by the valve tip.

13. The shock absorbing UBHO/pulser assembly of claim 7, further comprising:

a generally cylindrical piston received over and affixed to the second end of the valve stem; and a generally tubular stinger extension having first and second ends, the first end of the stinger housing received over the second end of the stinger, the stinger extension further having an interior stinger extension wall with a predetermined stinger extension wall diameter, the stinger extension wall diameter selected such that the piston on the first end of the valve stem is in sealed reciprocating piston engagement with the stinger extension wall.

14. The shock absorbing UBHO/pulser assembly of claim 13, further comprising:

the first end of the crossover sub further providing a recessed piston housing, the piston housing shaped to receive and abut with the piston as affixed to the second end of the valve stem, wherein abutment of the piston against the piston housing limits displacement of the first end of the valve stem in a direction towards the second end of the stinger.

15. The shock absorbing UBHO/pulser assembly of claim 8, further comprising:

a generally cylindrical piston received over and affixed to the second end of the valve stem; and a generally tubular stinger extension having first and second ends, the first end of the stinger housing received over the second end of the stinger, the stinger extension further having an interior stinger extension wall with a predetermined stinger extension wall diameter, the stinger extension wall diameter selected such that the piston on the first end of the valve stem is in sealed reciprocating piston engagement with the stinger extension wall.

16. The shock absorbing UBHO/pulser assembly of claim 15, further comprising:

the first end of the crossover sub further providing a recessed piston housing, the piston housing shaped to receive and abut with the piston as affixed to the second end of the valve stem, wherein abutment of the piston against the piston housing limits displacement of the first end of the valve stem in a direction towards the second end of the stinger.

17. The shock absorbing UBHO/pulser assembly of claim 7, in which reciprocating displacement of the valve stem within the stinger is independent of dampening radial spring bias between the stinger and the shock sleeve.

18. The shock absorbing UBHO/pulser assembly of claim 8, in which reciprocating displacement of the valve stem within the stinger is independent of reciprocating displacement of the shock sleeve with respect to the sub collar.

19. A shock absorbing universal bore hole orientation (UBHO)/pulser assembly, comprising:

a substantially tubular sub collar having a substantially cylindrical interior wall, the interior wall providing an annular collar shoulder;

a generally cylindrical UBHO sleeve having first and second ends, a substantially cylindrical main orifice unit received into the first end of the UBHO sleeve, the main orifice unit and the UBHO sleeve together received into the sub collar until the first end of the UBHO sleeve abuts against the annular collar shoulder;

a generally cylindrical shock sleeve having first and second ends, the second end of the shock sleeve providing an internal circular opening, the first end of the shock sleeve received over the second end of the UBHO sleeve;

a helical lower shock spring interposed between the first end of the shock sleeve and the second end of the UBHO sleeve such that the shock sleeve is in compression spring bias with the UBHO sleeve;

at least one cylindrical sub collar compression ring affixed to the interior wall of the sub collar;

a helical upper shock spring interposed between the sub collar compression ring and the second end of the shock sleeve such that the shock sleeve is in compression spring bias with the sub collar compression ring;

the upper and lower shock springs engaged in reciprocating compression and release so as to allow the shock sleeve dampened reciprocating displacement with respect to the sub collar via compensating compression spring bias between the upper and lower shock springs;

a generally tubular valve stem having first and second ends, a valve tip connected to the first end of the valve stem, a generally cylindrical piston received over and affixed to the second end of the valve stem; the second end of the valve stem further providing an exterior annular valve stem shoulder, the valve stem shoulder located towards the first end of the valve stem and away from the piston;

a generally tubular orienting stinger having first and second ends, first end of the valve stem received into the second end of the stinger so as to allow the valve stem reciprocating displacement within the stinger, the second end of the stinger providing a stinger shoulder, wherein abutment of the stinger shoulder against the valve stem shoulder limits displacement of the first end of the valve stem in a direction away from the second end of the stinger;

a generally tubular stinger extension having first and second ends, the first end of the stinger housing received over the second end of the stinger, the stinger extension further having an interior stinger extension wall with a predetermined stinger extension wall diameter, the stinger extension wall diameter selected such that the piston on the first end of the valve stem is in sealed reciprocating piston engagement with the stinger extension wall;

a crossover sub having first and second ends, the first end of the crossover sub received into the second end of the stinger extension, the second end of the crossover sub configured for mating with a mud pulse transmitter servo controller, the first end of the crossover sub further providing a recessed piston housing, the piston housing shaped to receive and abut with the piston as affixed to the second end of the valve stem, wherein abutment of the piston against the piston housing limits displacement of the first end of the valve stem in a direction towards the second end of the stinger;

a helical valve spring interposed between the valve stem and the stinger, such that compression bias of the valve spring discourages displacement of the first end of the valve stem in a direction towards the second end of the stinger;

the stinger received into the circular opening in the shock sleeve such that an exterior mating portion of the stinger engages with a corresponding interior mating portion of the shock sleeve, at least one shock absorbing stinger compression ring interposed and compressed between the exterior mating portion of the stinger and the interior mating portion of the shock sleeve, wherein the compressed shock absorbing stinger compression ring provides dampening radial spring bias between the stinger and the shock sleeve; and wherein engagement of the stinger within the shock sleeve allows the stinger dampened reciprocating displacement with respect to the sub collar via compensating compression spring bias between the upper and lower shock springs, and wherein reciprocating displacement of the piston causes corresponding displacement of the valve tip towards and away from the main orifice unit, and wherein compression spring bias of the helical valve spring encourages restriction of the main orifice unit by the valve tip.

20. The shock absorbing UBHO/pulser assembly of claim 19, further comprising:

a mud filter screen received over the second end of the shock sleeve, the mud filter screen configured to remove particulate matter from fluid prior to said fluid encountering the shock sleeve.

* * * * *